US006019018A

United States Patent [19]

Wilson

[11] Patent Number: 6,019,018

[45] Date of Patent: Feb. 1, 2000

[54] GRIND STONE REMOVING WRENCH AND METHOD OF USING SAME

[76] Inventor: Tim R. Wilson, 1805 2nd Ave. N., Moorhead, Minn. 56560

[21] Appl. No.: 08/876,159

[22] Filed: Jun. 13, 1997

[51] Int. Cl.[7] ..... B25B 13/28

[52] U.S. Cl. ..... 81/98; 81/3.44

[58] Field of Search ..... 81/98, 111, 176.15, 81/176.2, 176.3, 3.42, 3.44; 451/429

[56] References Cited

U.S. PATENT DOCUMENTS

| | | | |
|---|---|---|---|
| 496,753 | 5/1893 | Smith et al. | 81/98 |
| 921,250 | 5/1909 | Hough | 81/3.44 |
| 953,467 | 3/1910 | Kahn | 81/3.44 |
| 1,110,908 | 9/1914 | Dickerman | 81/3.44 |
| 1,206,129 | 11/1916 | Murray | 81/3.44 |
| 1,506,640 | 8/1924 | Hummel | 81/3.42 |
| 1,894,202 | 1/1933 | Smith | 81/3.44 |
| 3,274,864 | 9/1966 | Chapman | 81/124.2 |

*Primary Examiner*—David A. Scherbel
*Assistant Examiner*—Joni B. Danganan
*Attorney, Agent, or Firm*—Michael S. Neustel

[57] ABSTRACT

A grind stone removing wrench for providing a means for simple and easy removal of grind stones from a profile grinder without damaging the profile grinder. The inventive device includes an arm member having a first flange projecting a finite portion from a first end thereof, a planar member pivotally attached to an end of the arm member mesial the first flange and the end opposite of the first end, the planar member including a second flange opposite of the pivoting point, and a handle secured to the arm member for allowing manual manipulation of the present invention so as to bring together the first flange and the second flange for grasping the grind stone from within a profile grinder. The handle preferably includes a first portion secured orthogonally to the arm member and an second portion substantially orthogonal to the first portion for avoiding safety shields of the profile grinder.

5 Claims, 2 Drawing Sheets

GRIND STONE REMOVING WRENCH AND METHOD OF USING SAME

BACKGROUND OF THE INVENTION

1. Field of the Invention

The present invention relates to wrenches with pivoting jaws and more specifically it relates to a grind stone removing wrench and method of using same.

2. Description of the Prior Art

There are numerous wrenches with pivoting jaws for removing jar lids, oil filters and various other cylindrical shaped objects threadably attached. For example, U.S. Pat. No. 2,002,906 to Mullan; U.S. Pat. No. 2,606,465 to Downs; U.S. Pat. No. 2,575,950 to Fredholm; U.S. Pat. No. 3,240,086 to Way; and U.S. Pat. No. 2,496,262 to Barclay are all illustrative of such prior art.

However, while these devices may be suitable for the particular purpose to which they address, they are not suitable for removing a large cylindrical grind stone from a profile grinder utilized for grinding rails on a railroad track. Since there are no devices for removing said grind stones from the profile grinders, workers generally are left to utilize a hammer device to jar said grind stone loose from within the profile grinder by hammering said grind stone in a counter-clockwise motion. This tends to bend the shaft connecting said grind stone and sometimes causes damage to the exterior portion of the profile grinder itself.

Mullan teaches a can top remover, of the type having a fixed jaw and a pivotally mounted adjustable jaw, means which will secure the adjustable jaw in proper spaced relation with the fixed jaw when the adjustable jaw is moved into an operative position against a can top.

Downs teaches a wrench having a plurality of closure-engaging jaws which may be readily extended and retracted to engage closures and like articles of varying sizes.

Fredholm teaches a jar closure wrench comprising a pair of arcuate arms having adjacent ends thereof pivotally connected, an operating handle, and a plurality of yieldable arcuate gripping shoes disposed within said arms.

Way teaches a tool for removing throw-away automobile filter cartridges. Barclay teaches a jar lid wrench for removing jar lids by applying gripping force over a substantial area of the periphery of the lid.

While the prior art may perform its intended function, none of the prior art provides a wrench for removing grind stones from a profile grinder.

SUMMARY OF THE INVENTION

A primary object of the present invention is to provide a grind stone removing wrench that will overcome the shortcomings of the prior art devices.

Another object is to provide a grind stone removing wrench that easily fits over a grind stone within a profile machine for removing the grind stone without engaging obstructions from the profile machine.

An additional object is to provide a grind stone removing wrench which is designed to extend the useful life of a shaft within a profile grinder and also the useful life of the profile grinder.

A further object is to provide a grind stone removing wrench which is simple and easy to use.

Another object is to provide a grind stone removing wrench which does not damage a shaft of a profile grinder when removing a grind stone.

Further objects of the invention will appear as the description proceeds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
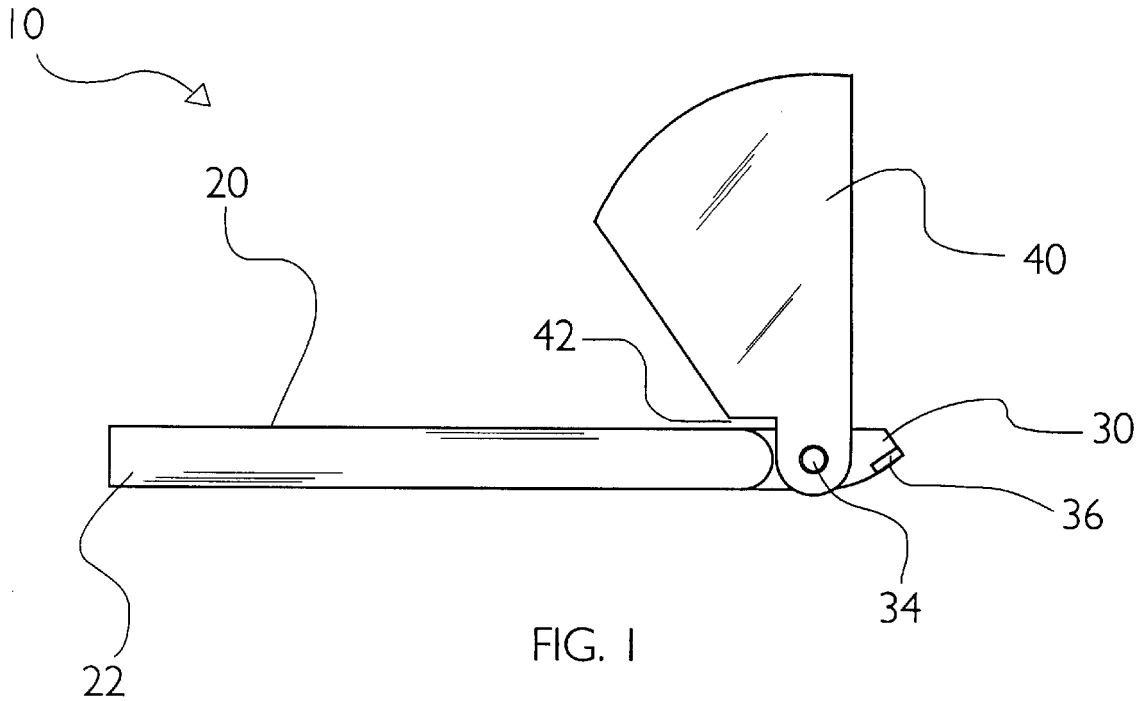
FIG. 1 is a top view of the present invention.

With reference now to the drawings, and in particular to FIGS. 1 through 4 thereof, a new grind stone removing wrench embodying the principles and concepts of the present invention and generally designated by the reference numeral 10 will be described.

More specifically, it will be noted that the grind stone removing wrench 10 comprises an arm member 30 having a first flange 32 projecting a finite portion from a first end thereof. A planar member 40 is pivotally attached to an end of the arm member 30 mesial the first flange 32 and the end opposite of the first end. The planar member 40 includes a second flange 44 opposite of the pivoting point. A handle 20 is secured to the arm member 30 for allowing manual manipulation of the present invention so as to bring together the first flange 32 and the second flange 44 for grasping the grind stone 12 from within a profile grinder. The handle 20 preferably includes a first portion 24 secured orthogonally to the arm member 30 and a second portion 22 substantially orthogonal to the first portion 24 for avoiding safety shields of the profile grinder.

Figure 2:
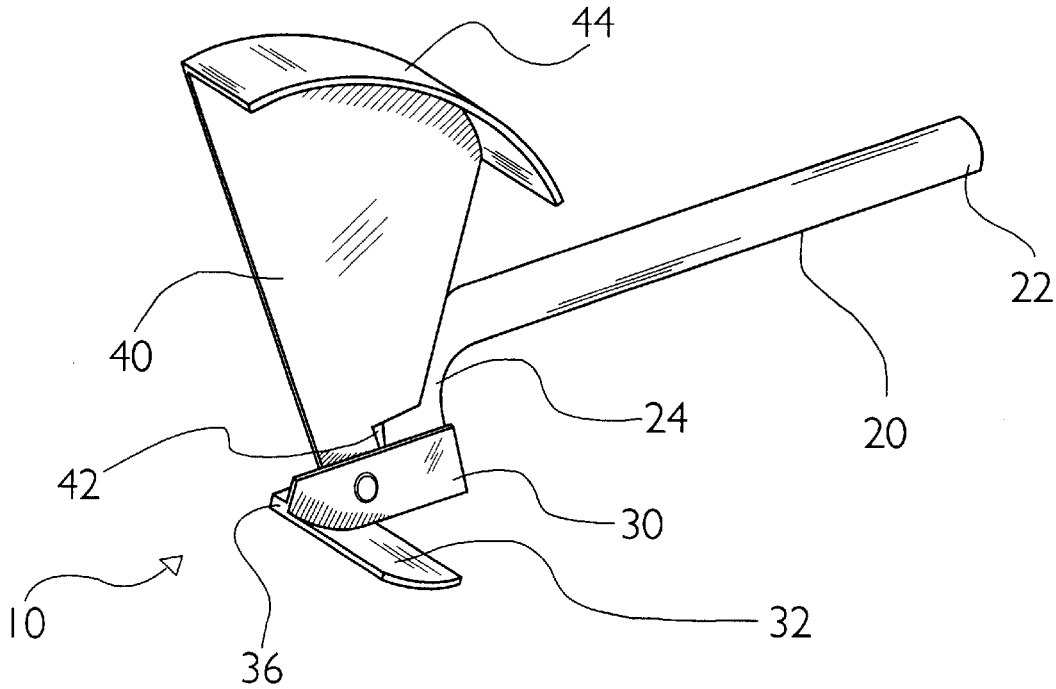
FIG. 2 is an upper perspective view of an interior portion of the present invention.
Figure 3:
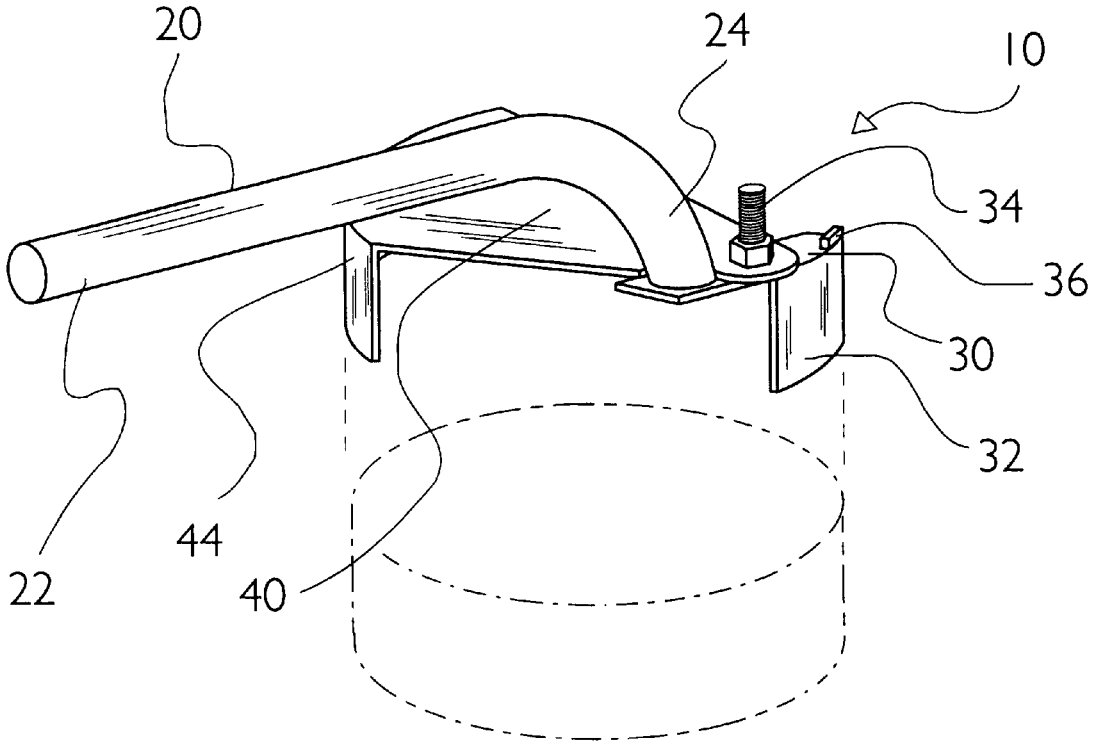
FIG. 3 is an upper perspective view of the present invention distally spaced above a grind stone.
Figure 4:
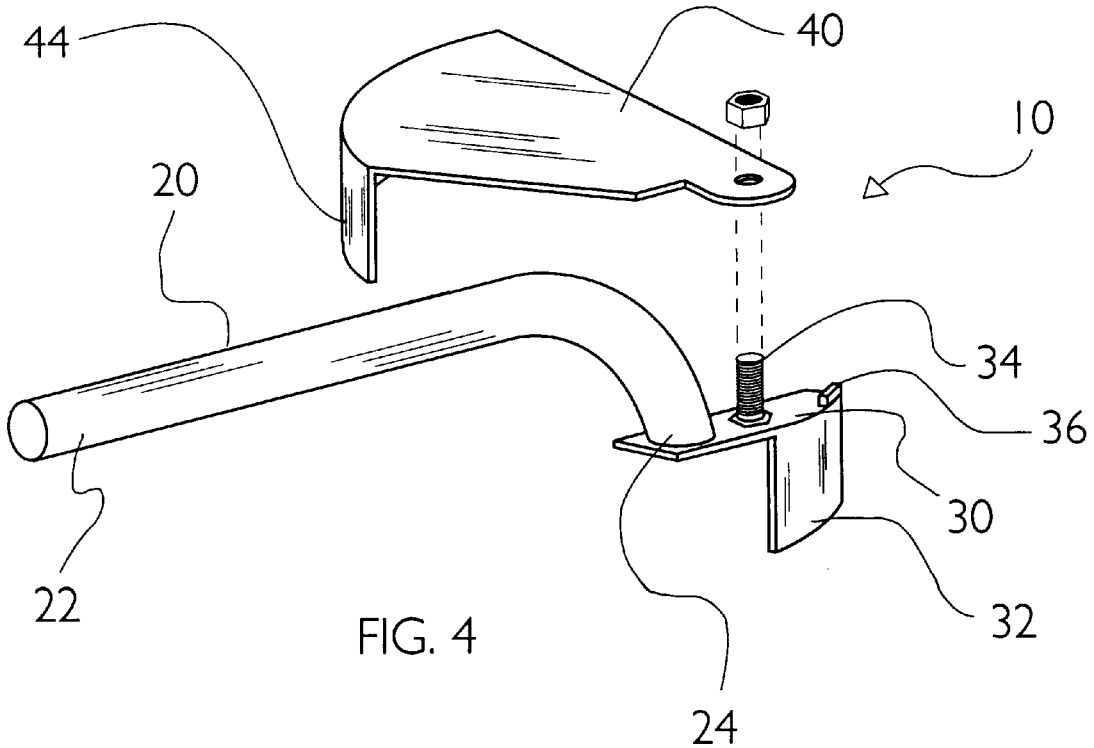
FIG. 4 is an exploded upper perspective view of the present invention.

The arm member 30 has a first end and a second end as best shown in FIG. 2 of the drawings. The arm member 30 includes a first flange 32 projecting downwardly from near the second end to near a concentric portion of the arm member 30 as best shown in FIG. 3 of the drawings. The first flange 32 includes at least one side for engaging a portion of an outer circumference of the grind stone 12. Preferably, the first flange 32 is arcuate shaped for engaging the grind stone 12.

The planar member 40 has a narrow end and a broad end as shown in FIG. 2 of the drawings. The narrow end is pivotally attached to the arm member 30 between the first flange 32 and the first end so as to position the planar member 40 parallel to the arm member 30. The planar member 40 includes a second flange 44 projecting downwardly from the broad end as best shown in FIG. 3 of the drawings. The second flange 44 includes at least one side for engaging a portion of the outer circumference of the grind stone 12 opposite of the first flange 32. The second flange 44 is preferably arcuate shaped for engaging the grind stone 12. Both the first flange 32 and the second flange 44 have an interior radius substantially equal to a radius of the grind stone 12 for snugly engaging the outer circumference of the grind stone 12 as shown in FIG. 1 of the drawings. The planar member 40 preferably includes a cutout adjacent the end pivotally attached to the arm member 30 for removably receiving the handle 20 during pivoting of the arm member 30 in relation to the planar member 40.

The handle 20 is secured to the first end of the arm member 30 for pivoting the arm member 30 in relation to the planar member 40 thereby contracting the first flange 32 and the second flange 44 upon the grind stone 12. The contracting of the first flange 32 and the second flange 44 toward one another grips the grind stone 12 for allowing rotation and removal of the grind stone 12 as shown in FIG. 3 of the drawings. The handle 20 preferably comprises a first portion 24 and an second portion 22. The first portion 24 has a lower end, wherein the lower end is attached substantially orthogonal to the first end of the arm member 30 as best shown in FIG. 3 of the drawings. The second portion 22 is angled with respect to the first member. The angle between the second portion 22 and the first portion 24 is preferably 90 degrees.

In use, the handle 20 is rotated clockwise to separate the first flange 32 and the second flange 44. A pin is inserted into a shaft of the profile grinder to prevent rotation of the shaft. The first flange 32 and the second flange 44 are positioned around the grind stone 12 so as to be adjacent the outer circumference of the grind stone 12. The handle 20 is thereafter rotated counter-clockwise so as to bring the first flange 32 and the second flange 44 juxtaposed to and engaging the outer circumference of the grind stone 12. The handle 20 is further rotated counter-clockwise to loosen the grind stone 12 from the shaft of the profile grinder. Because the second portion 22 of the handle 20 is distally spaced from the parallel plane of the arm member 30, an obstructions of the profile grinder, such as safety shields, are avoided during the rotation process. Once the grind stone 12 is loosened, the grind stone 12 may be removed by hand if possible or further rotation of the present invention may be required.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grind stone removing wrench, comprising:

an arm member having a first end and a second end;

said arm member includes a first flange from near said second end to near a central portion of said arm member;

wherein said first flange includes at least one side for engaging a portion of an outer circumference of said grind stone;

a planar member having an end pivotally attached to said arm member between said first flange and said first end whereas said planar member is parallel to said arm member;

said planar member includes a second flange opposite of said arm member;

wherein said second flange includes at least one side for engaging a portion of said outer circumference of said grind stone opposite of said first flange;

a handle secured to said first end of said arm member for pivoting said arm member in relation to said planar member thereby contracting said first flange and said second flange upon said grind stone thereby engaging said grind stone for allowing removal thereof;

wherein said handle comprises:

a first portion attached substantially orthogonal to said first end of said arm member; and a second portion, wherein said second portion is angled with respect to said first portion;

said first flange is arcuate shaped;

said second flange is arcuate shaped for fittingly engaging said outer circumference of said grind stone;

wherein said first flange and said second flange have an interior radius substantially equal to a radius of said grind stone; and wherein said planar member includes a cutout adjacent said end pivotally attached to said arm member for removably receiving said first portion of said handle during pivoting of said arm member in relation to said planar member.

2. The grind stone removing wrench of claim 1, wherein said second portion of said handle is substantially orthogonal to said first portion of said handle.

3. A method of removing a grind stone from a profile grinder without causing damage to said profile grinder, said method comprising the steps of:

(a) providing said grind stone mechanically connected to said profile grinder;

(b) locking a shaft of said profile grinder which threadably secures said grind stone;

(c) positioning a second flange of a planar member adjacent an outer circumference of said grind stone;

(d) rotating an arm member pivotally attached to said planar member opposite of said second flange so as to position a first flange of said arm member adjacent said outer circumference of said grind stone opposite said second flange; and (e) rotating a handle attached to said arm member in a counter-clockwise motion forcing said first flange and said second flange to snugly engage said grind stone and thereby rotating said grind stone with respect to said shaft thereby loosening said grind stone from said shaft of said profile grinder until said grind stone is removed from said shaft.

4. A grind stone removing wrench for engaging and removing a grind stone from a profile grinder, comprising:

an arm member having a first end and a second end;

said arm member includes a first flange from near said second end to near a central portion of said arm member;

wherein said first flange includes at least one side for engaging a portion of an outer circumference of said grind stone;

a planar member having an end pivotally attached to said arm member between said first flange and said first end whereas said planar member is parallel to said arm member;

said planar member includes a second flange opposite of said arm member;

wherein said second flange includes at least one side for engaging a portion of said outer circumference of said grind stone opposite of said first flange;

a handle secured to said first end of said arm member for pivoting said arm member in relation to said planar member thereby contracting said first flange and said second flange upon said grind stone thereby engaging said grind stone for allowing removal thereof;

wherein said handle comprises:

a first member attached substantially orthogonal to said first end of said arm member; and a second member attached to said first member opposite of said arm member, wherein said second member is angled with respect to said first member;

said first flange is arcuate shaped;

said second flange is arcuate shaped for fittingly engaging said outer circumference of said grind stone;

wherein said first flange and said second flange have an interior radius substantially equal to a radius of said grind stone; and wherein said planar member includes a cutout adjacent said end pivotally attached to said arm member for removably receiving said first member of said handle during pivoting of said arm member in relation to said planar member.

5. The grind stone removing wrench of claim 4, wherein said second member of said handle is substantially orthogonal to said first member of said handle.

* * * * *